US009512653B2

(12) United States Patent
Dalton, Jr. et al.

(10) Patent No.: US 9,512,653 B2
(45) Date of Patent: Dec. 6, 2016

(54) ADJUSTABLE CAM FOR CAM LOCK

(75) Inventors: Robert E. Dalton, Jr., Mauldin, SC (US); Matthew Greiner, Simpsonville, SC (US)

(73) Assignee: CompX International Inc., Greenville, SC (US)

( * ) Notice: Subject to any disclaimer, the term of this patent is extended or adjusted under 35 U.S.C. 154(b) by 822 days.

(21) Appl. No.: 13/523,318

(22) Filed: Jun. 14, 2012

(65) Prior Publication Data

US 2012/0248794 A1 Oct. 4, 2012

Related U.S. Application Data

(62) Division of application No. 12/486,837, filed on Jun. 18, 2009, now abandoned.

(60) Provisional application No. 61/073,789, filed on Jun. 19, 2008.

(51) Int. Cl.

| | |
|---|---|
| ***E05C 3/06*** | (2006.01) |
| ***E05C 3/04*** | (2006.01) |
| ***E05B 63/00*** | (2006.01) |

(52) U.S. Cl.

CPC ..... *E05C 3/042* (2013.01); *E05B 63/006* (2013.01); *E05B 63/0056* (2013.01); *Y10T 292/1077* (2015.04)

(58) Field of Classification Search

CPC ..... E05B 63/0056; E05B 63/006; E05C 3/042
USPC ..... 292/194, 251, 257, 197; 70/91, 127, 447
See application file for complete search history.

(56) References Cited

U.S. PATENT DOCUMENTS

| | | | | |
|---|---|---|---|---|
| 5,152,161 | A | 10/1992 | Lee | |
| 5,230,542 | A * | 7/1993 | Wiese | E05B 15/0205 292/241 |
| 6,041,627 | A * | 3/2000 | Buckland | E05B 17/0025 292/DIG. 60 |
| 6,099,054 | A * | 8/2000 | Glass | E05B 15/0225 292/241 |
| 6,361,088 | B1 | 3/2002 | Ramsauer | |
| 6,568,226 | B1 | 5/2003 | Ramsauer | |
| 6,659,513 | B1 | 12/2003 | Ramsauer | |
| 6,843,082 | B2 | 1/2005 | Vickers | |
| 6,945,573 | B2 * | 9/2005 | Ruiz | E05B 65/006 292/109 |

(Continued)

FOREIGN PATENT DOCUMENTS

| | | | | |
|---|---|---|---|---|
| GB | 2432881 | A * | 6/2007 | E05B 15/10 |

OTHER PUBLICATIONS

Jan. 3, 2013 Office Action issued for U.S. Appl. No. 12/486,837.

*Primary Examiner* — Kristina Fulton
*Assistant Examiner* — Christine M Mills
(74) *Attorney, Agent, or Firm* — Dority & Manning, P.A.

(57) ABSTRACT

Disclosed are apparatus and methodology for fine tuning the fit and function of a cam lock used to secure an enclosure or similar. A cam lock is provided with a cam and a set of variously sized adjustment pads that may be individually secured at one end of the cam. The adjustment pads each differ in thickness, and are installable on the cam without the need of tools. The variously sized adjustment pads allow field installation and adjustment of the position of cam contact surfaces to easily and quickly adjust positioning for spacing variations due to manufacturing tolerances. Such customized installation provides improved security, reduced noise and rattle of the enclosure door, and a more professional aspect to the installation.

12 Claims, 2 Drawing Sheets

(56) References Cited

U.S. PATENT DOCUMENTS

| | | | | |
|---|---|---|---|---|
| 6,953,209 | B2 | 10/2005 | Jackson et al. | |
| 7,695,029 | B2 * | 4/2010 | Ramsauer | 292/67 |
| 2008/0134733 | A1 * | 6/2008 | Anastasiadis et al. | 70/89 |

* cited by examiner

ADJUSTABLE CAM FOR CAM LOCK

PRIORITY CLAIM

This application is a divisional of prior pending U.S. patent application Ser. No. 12/486,837 filed Jun. 18, 2009 now abandoned entitled "ADJUSTABLE CAM FOR CAM LOCK", which is hereby incorporated herein by reference in its entirety for all purposes. This application also claims the benefit of a previously filed U.S. Provisional Patent Application of the same title filed Jun. 19, 2008 and bearing U.S. Ser. No. 61/073,789, which is likewise incorporated herein by reference for all purposes. Any disclaimer that may have occurred during prosecution of the above-referenced applications is hereby expressly rescinded.

FIELD OF THE INVENTION

The present subject matter relates to locking devices and/or component fittings relative to an enclosure. More particularly, the present subject matter relates to a locking bar or cam provided with varying thickness components to fine tune the fit and function of a cam lock used to secure an enclosure or similar.

BACKGROUND OF THE INVENTION

Cam locks correspond to a relatively well known lock type that finds many uses in securing enclosures including for example, but not limited to, cabinets, drawers, and desks. Typically, in cam lock applications, the cam, upon rotation, contacts the inside of an associated enclosure frame or a strike fitted to such frame. Often, the physical dimensions of the enclosure frame and any associated strike will vary considerably between different applications and possibly even within identical applications as a result of manufacturing tolerances.

In order to provide structure and associated methodology for compensating for such manufacturing tolerances, as well as to provide a range of lock sizes to accommodate multiple uses for a single cam lock, many manufacturers provide cam lock kits with plural cams. In an exemplary configuration, both a straight cam and a double formed or offset cam may be provided with a single lock so that a preferable one of either of such cams may be selectively used in a single installation. The offset cam may be configured so that the direction of the offset may be reversed. Under such an arrangement, with both a single straight cam and an offset cam being provided, up to three separate configurations may be implemented.

Alternative configurations have been provided in the art for adjustment of the spacing of the cam from, for example, a front surface of a mounting location. U.S. Pat. No. 5,152,161 (Lee) illustrates one such configuration where a threaded cam bolt is provided to allow for cam adjustment. The disclosure of the foregoing patent is fully incorporated herein for all purposes.

While various implementations of cam locks have been developed, and while various formations of cams have been developed, no design has emerged that generally encompasses all of the desired characteristics as hereafter presented in accordance with the present subject matter.

SUMMARY OF THE INVENTION

In view of the recognized features encountered in the prior art and addressed by the present subject matter, improved apparatus and methodology have been provided for an adjustable cam for use with a cam lock and/or improved component fittings relative to an enclosure.

The benefit of the present subject matter over prior fixed cams is to allow fine tuning of the cam contact surface position relevant to the associated frame or strike, in order to improve the fit and function of the cam lock. By improving fit and function of the cam, movement of the associated enclosure door or similar relative to the associated frame is minimized. Such improvements provide several benefits including, but not limited to, improved security, reduced noise and rattle of the enclosure door, and a more professional aspect to the installation.

In an exemplary configuration, a double formed or offset cam is provided with features to adjust the effective position of a surface contacting portion of the cam.

In one of more simple alternative present forms, cam adjustment pads are provided in accordance with present subject matter in several selectable sizes, in order to provide fine tuning of the spacing from a cam contact surface.

Another positive aspect of the present subject matter is that adjustments to cam surface spacing may be readily made in the field without the use of tools.

In accordance with aspects of certain embodiments of the present subject matter, methodologies are provided which allow construction of a cam lock that may be adaptively incorporated (i.e., custom fitted) into a variety of associated enclosures despite manufacturing tolerances.

One present exemplary embodiment relates to a cam lock for locking an enclosure, comprising a cam lock assembly receivable in an enclosure to be locked thereby; a locking bar supported on such cam lock assembly and positioned so as to be actuated thereby relative to an associated enclosure to be locked; and a stop pad removably supported on such locking bar, for adjustment of such locking bar actuation relative to an associated enclosure, whereby the fit and function of such cam lock relative to an associated enclosure is adjustable.

In some variations of the foregoing, such locking bar may include a first portion for removable mounting thereof on such cam lock assembly, and a second portion thereof for receipt of such removable stop pad. Still further, optionally, such locking bar first portion may be offset from such second portion thereof; and such locking bar may be reversible such that the resulting position of such second portion is changeable relative to an associated enclosure, for further adjustment relative thereto.

In other variations of the foregoing, such cam lock may further include a plurality of such stop pads of varying thickness, for selective removable support thereof on such locking bar. Also optionally, such stop pad may include a post; and such locking bar second portion may define an opening for receipt of such stop pad post. In some instances, such stop pad post may be configured for an interference fit with such locking bar second portion opening. In others, such post and such locking bar second portion opening may be respectively threaded, for threaded receipt of such post with such locking bar second portion opening. Yet in others, such post and such locking bar second portion opening may be mated with one of a snap fit arrangement and adhesives.

Another present exemplary embodiment of the present subject matter may relate to an adjustable cam lock for locking an associated enclosure by contact of cam contact surfaces with a protective strike fitted to a frame of such an associated enclosure. Such an exemplary adjustable cam lock may preferably comprise a cam lock assembly receivable in an enclosure to be locked thereby; an offset cam bar removably supported on such cam lock assembly and positioned so as to be actuated thereby relative to an associated enclosure to be locked; and a set of variously sized adjustment pads. Such set of adjustment pads may preferably be individually secured at one end of such cam bar to form a cam contact surface, for adjustment of such cam contact surface of such cam bar relative to a protective strike of an associated enclosure. With such an arrangement, advantageously, the fit and function of such cam lock relative to an associated enclosure is adjustable.

In some alternatives of the foregoing, such adjustment pads each may differ in thickness, and may be removably installable on such cam bar without the need of tools, to provide customized installation of such cam lock for reduced noise and improved security. In still further alternatives, each of such adjustment pads may respectively comprise a first pad portion having a predetermined thickness and a second pad portion comprising a post, configured to be removably fitted to one end of such offset cam bar.

In other present alternatives, each of such pad posts may be respectively configured for one of an interference fit, a threaded fit, and a snap fit with such offset cam bar.

In other exemplary variations of the foregoing, one end of such offset cam bar may define an opening therethrough; and such adjustable cam lock may further include a mechanism for removably securing such offset cam bar on such cam lock assembly.

It is to be understood that the present subject matter equally relates to both apparatus and methodology. One present exemplary method relates to a method of custom fitting a first surface with an enclosure having a second surface, for selectively mating such respective surfaces Such exemplary method preferably comprises providing a component for fitted support relative to an enclosure; and removably supporting a stop pad on such component, such stop pad having a first surface selectively engaging a second surface of such enclosure for adjustment of such component relative to the associated enclosure. Advantageously, with such methodology, the fit of such component first surface relative to an associated enclosure second surface is adjustable.

In an exemplary variation of the foregoing methodology, such enclosure second surface may comprise a strike surface, and such component may include a cam lock. Preferably, in such exemplary variation, such method may further include providing a cam lock assembly receivable in such associated enclosure to be locked thereby; supporting a locking bar on such cam lock assembly and positioned so as to be actuated thereby relative to the associated enclosure to be locked; and removably supporting the stop pad on such locking bar, for adjustment of such locking bar actuation relative to the associated enclosure. In such exemplary variation, advantageously the fit and function of such cam lock relative to an associated enclosure strike surface is adjustable.

In other present variations of the foregoing, such method may further include providing a plurality of such stop pads of varying thickness; and selectively removably supporting one of such stop pads on such locking bar for a selected fit relative to such associated enclosure strike surface. In some further alternatives of the foregoing, such locking bar may be provided with a first portion for removable mounting thereof on such cam lock assembly, and a second portion thereof for receipt of such removable stop pad. Still further, such locking bar first portion may be offset from such second portion thereof; and the position of such locking bar is reversibly selected such that the resulting position of such second portion is changeable relative to the associated enclosure, for further adjustment relative thereto. In yet other present exemplary variations, such stop pad may include a post; and such locking bar second portion may define an opening for receipt of such stop pad post. Still further, such stop pad post and such locking bar second portion opening may be respectively configured for one of an interference fit, a threaded fit, or a snap fit. In other alternatives, such post and such locking bar second portion opening may be mated with adhesives.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the present subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1A:
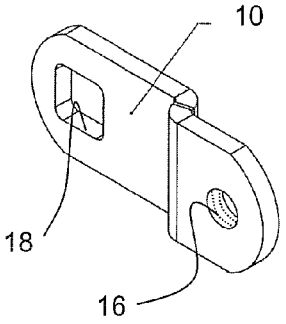
FIG. 1A illustrates an exemplary embodiment of a double formed or offset locking bar or cam for use in accordance with the present subject matter.

3B, fitted with an exemplary adjustable cam lock assembly per the present subject matter.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with an adjustable cam for use with a cam lock.

Selected combinations of aspects of the disclosed subject matter correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Figure 1B:
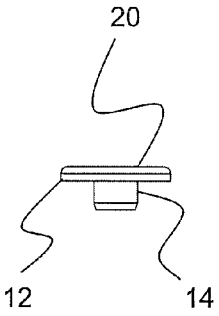
FIGS. 1B through 1D respectively illustrate collectively a set of three respective exemplary stop pads of varying head thickness that may be associated with a cam, in accordance with the present subject matter.
Figure 1C:
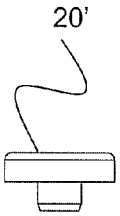
Figure 1D:
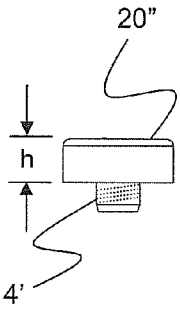

Reference will herein be made in detail to the presently preferred embodiments of the subject adjustable cam for use with cam locks. Referring to the drawings, FIG. 1A illustrates a double formed or offset locking bar or cam 10, as will be understood by those of ordinary skill in the art, for use with a cam lock. FIGS. 1B through 1D respectively illustrate three stop pads 20, 20', and 20", which collectively comprise per the present subject matter a set of three pads of varying head thickness "h" that may be associated with the exemplary cam 10. As representatively illustrated by stop pad 20 (see FIG. 1B), the stop pads 20 correspond to a first pad portion 12 that may have varying thicknesses "h" as marked per the specific dimension illustrated in association with stop pad 20" (see FIG. 1D).

A second portion of stop pad 20 per the present subject matter corresponds to a post 14. In an exemplary first configuration, post 14 (see FIG. 1B) may be sized to be press fitted into a circular hole 16 provided in one end of cam 10. In a second configuration of such post 14, it may be threaded, as illustrated by dotted line threads at 14' in association with pad 20" (see FIG. 1D) such that the threaded post may be secured into a threaded hole 16 as denoted by the threads of hole 16 shown in alternative illustration by the use of dotted lines (see FIG. 1A).

It should be appreciated by those of ordinary skill in the art that each of the respective exemplary stop pads 20, 20', and 20" may be selectively affixed to the cam per the present subject matter using a variety of methods including, though not limited to, the previously mentioned screw fit or press fit into hole 16 provided in cam 10. Examples of such alternatives may include adhesive or snap fit approaches. Alternatively, per the present subject matter, the cam end may be encased by use of a sleeve or the like to secure an exemplary stop pad. Use of a method which requires no tools or machinery to install or remove a present stop pad is preferable as it allows for more simple field adjustment of the cam.

Figure 2:
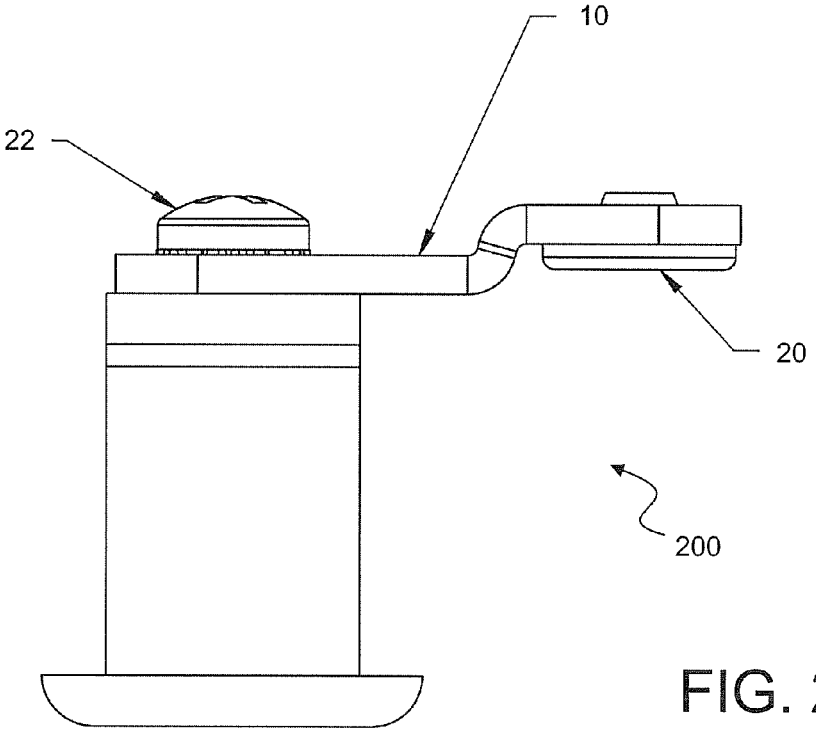
FIG. 2 illustrates a typical cam lock assembly that has been provided with a cam in which has been inserted an exemplary stop pad, in accordance with present subject matter.

With further reference to FIG. 1A, as is also illustrated, a second end of cam 10 may be provided per present subject matter with a rectangular hole 18 to accommodate mounting of cam 10 on a corresponding rectangular shaped portion of lock assembly 200, such as illustrated in present FIG. 2.

With reference to present FIG. 2, there is illustrated a typical cam lock assembly generally 200 that has been provided with a cam 10 in which has been inserted an exemplary stop pad 20 in accordance with the present subject matter. Further, a screw 22 may be employed per present subject matter to secure cam 10 to cam lock assembly 200. It should be appreciated that cam 10 may alternatively per present subject matter be secured to cam lock assembly 200 either oriented as illustrated in FIG. 2 or, alternatively, with the bent portion thereof oriented in the opposite direction from that illustrated. As those of ordinary skill in the art will appreciate, such alternative mounting will provide double the effective thickness adjustment options for pads 20, 20', and 20" per the present subject matter.

Figure 3B:
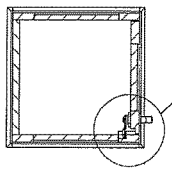
FIG. 3B illustrates a cross-sectional view of the exemplary enclosure of FIG. 3A, taken along lines A-A of FIG. 3A.
Figure 3A:
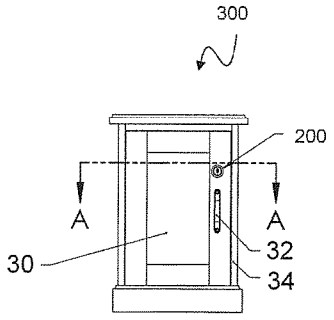
FIG. 3A illustrates a front elevation view of an exemplary enclosure with which the cam lock of the present subject matter may be associated.

With reference to FIG. 3A, there is illustrated a front elevation view of an exemplary enclosure 300 with which the cam lock 200 of the present subject matter may be associated. Enclosure 300 includes an exemplary frame 34 configured in cooperative relationship with a door or drawer 30 that may be opened by operation of exemplary handle 32. Enclosure 300 is secured from access by restricting the relative movement of door or drawer 30 and the associated enclosure frame 34 by way of cam lock 200.

Present FIG. 3B illustrates a cross-sectional view of the exemplary enclosure 300 of present FIG. 3A taken along section line A-A of FIG. 3A. FIG. 3B further designates area 310 thereof, that may be more clearly seen in the enlarged view thereof illustrated in present FIG. 3C.

Figure 3C:
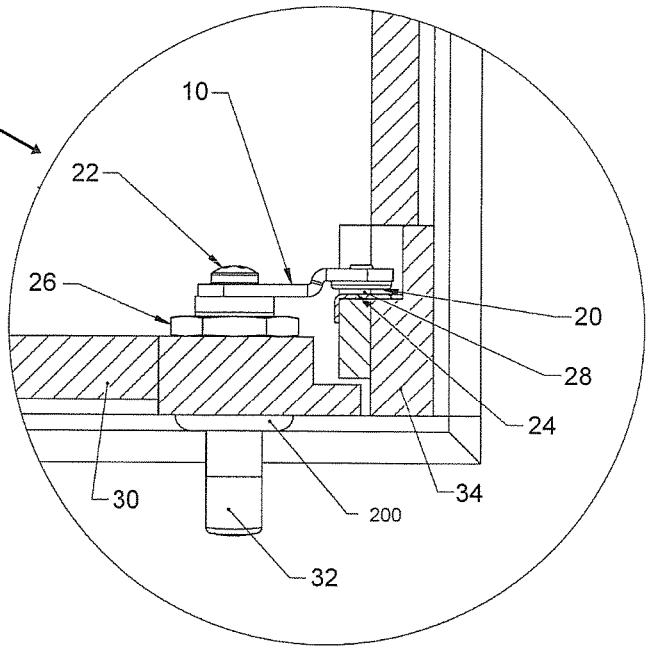
FIG. 3C illustrate an enlarged view of a portion of the cross section of the exemplary enclosure illustrated in FIG.

With reference to such enlarged view of present FIG. 3C, there is illustrated a cross section of exemplary enclosure 300 fitted with exemplary cam lock assembly 200, in accordance with present subject matter. In such exemplary embodiment, cam lock assembly 200 is inserted in the door 30 and preferably secured in place, such as with exemplary fastener 26. Cam 10 is then custom fitted with a selected one of the cam stops 20, 20', or 20" which, when installed per the present subject matter, will minimize the gap 28 between the cam stop and a protective strike 24 fitted to enclosure frame 34. The ability provided by the present subject matter to quickly and easily minimize gap 28 enables the realization of the benefits previously described.

While the present subject matter has been described in detail with respect to specific embodiments thereof, it will be appreciated that those skilled in the art, upon attaining an understanding of the foregoing, may readily produce alterations to, variations of, and equivalents to such embodiments. For example, FIGS. 3A, 3B, and 3C also represent an aspect of the present subject matter wherein an enclosure may be fitted more generally with an adjustable component per present subject matter, with such component comprising something other than the exemplary cam lock specifically illustrated. One example is that such component may comprise a sheet metal or similar component, forming an opening for receipt of a selected stop pad per present subject matter, which stop pad comprises a first surface which selectively interfaces with a strike surface or other second surface of such enclosure or similar, in order to provide a customized fitting of such component relative to the associated enclosure or similar. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A cam lock for locking an enclosure, comprising:

a cam lock assembly receivable in an enclosure to be locked thereby;

a locking bar supported on said cam lock assembly and positioned so as to be actuated thereby relative to said enclosure to be locked; and a stop pad of selected thickness removably supported on said locking bar, for adjustment of such locking bar actuation relative to said enclosure, whereby the fit and function of said cam lock relative to said enclosure is adjustable;

further including a plurality of said stop pads of respective different thicknesses, for selective removable support thereof on said locking bar.

2. A can lock as in claim 1, wherein said locking bar includes a first portion for removable mounting thereof on said cam lock assembly, and a second portion thereof for receipt of said removable stop pad.

3. A cam lock as in claim 2, wherein:

said locking bar first portion is offset from said second portion thereof; and said locking bar is reversible such that the resulting position of said second portion is changeable relative to said enclosure, for further adjustment relative thereto.

4. A cam lock as in claim 2, wherein:

each of said stop pads respectively includes a post; and said locking bar second portion defines an opening for receipt of said stop pad post.

5. A cam lock as in claim 4, wherein said stop pad post is configured for an interference fit with said locking bar second portion opening.

6. A cam lock as in claim 4, wherein said post and said locking bar second portion opening are respectively threaded, for threaded receipt of said post with said locking bar second portion opening.

7. A cam lock as in claim 4, wherein said post and said locking bar second portion opening are mated with one of a snap fit arrangement and adhesives.

8. An adjustable cam lock for locking an associated enclosure by contact of cam contact surfaces with a protective strike fitted to a frame of such an associated enclosure, comprising:

a cam lock assembly receivable in an enclosure to be locked thereby;

an offset cam bar removably supported on said cam lock assembly and positioned so as to be actuated thereby relative to said enclosure to be locked; and a set of variously sized adjustment pads that may be individually secured at one end of said cam bar to form a cam contact surface, for adjustment of such cam contact surface of said cam bar relative to a protective strike of said enclosure, whereby the fit and function of said cam lock relative to said enclosure is adjustable.

9. An adjustable cam lock as in claim 8, wherein said adjustment pads each differ in thickness, and are removably installable on said cam bar without the need of tools, to provide customized installation of such cam lock for reduced noise and improved security.

10. An adjustable cam lock as in claim 8, wherein each of said adjustment pads respectively comprise a first pad portion having a predetermined thickness and a second pad portion comprising a post, configured to be removably fitted to one end of said offset cam bar.

11. An adjustable cam lock as in claim 10, wherein each of said pad posts are respectively configured for one of an interference fit, a threaded fit, and a snap fit with said offset cam bar.

12. An adjustable cam lock as in claim 8, wherein:

one end of said offset cam bar defines an opening therethrough; and said adjustable cam lock further includes a mechanism for removably securing said offset cam bar on said cam lock assembly.

* * * * *